US005926851A

United States Patent [19]

Kovalik

[11] Patent Number: 5,926,851

[45] Date of Patent: Jul. 27, 1999

[54] GARMENT FOR HANDICAPPED OR ELDERLY INDIVIDUALS

[76] Inventor: Kathleen Kovalik, 683-17 Fairington La., Aurora, Ohio 44020

[21] Appl. No.: 08/892,148

[22] Filed: Jul. 14, 1997

[51] Int. Cl.[6] ..... A41D 13/00

[52] U.S. Cl. ..... 2/227; 2/114

[58] Field of Search ..... 2/227, 69, 79, 2/114, 70–73, 75, 78.1–78.3

[56] References Cited

U.S. PATENT DOCUMENTS

| | | | |
|---|---|---|---|
| Re. 26,360 | 3/1968 | Pagano | 2/227 |
| 269,479 | 1/1882 | Stretch | 2/227 |
| 765,181 | 7/1904 | Kempin | 2/227 |
| 1,082,737 | 12/1913 | Cowen | 2/227 |
| 1,091,665 | 3/1914 | Kirshen | 2/227 |
| 1,287,354 | 12/1918 | Lavign . | |
| 1,303,947 | 5/1919 | Noxon | 2/227 |
| 1,369,538 | 2/1921 | Paxton | 2/227 |
| 1,446,251 | 2/1923 | Goldsmith . | |
| 2,228,624 | 1/1941 | Frank | 2/227 |
| 2,390,077 | 12/1945 | De Grazia . | |
| 3,246,342 | 4/1966 | Pagano . | |
| 4,145,763 | 3/1979 | Abrams et al. . | |
| 4,258,440 | 3/1981 | McGowan . | |
| 4,389,733 | 6/1983 | Boykins, Jr. . | |
| 4,446,575 | 5/1984 | Davis . | |
| 4,644,589 | 2/1987 | Pettis . | |
| 4,736,467 | 4/1988 | Schwarze et al. . | |
| 4,825,475 | 5/1989 | Smart . | |
| 4,961,234 | 10/1990 | Leibman . | |
| 5,008,962 | 4/1991 | Smith et al. . | |
| 5,016,290 | 5/1991 | Askew . | |
| 5,027,438 | 7/1991 | Schwarze et al. | 2/227 |
| 5,115,518 | 5/1992 | Hofman | 2/227 |
| 5,341,515 | 8/1994 | Cohen . | |

FOREIGN PATENT DOCUMENTS

| | | | |
|---|---|---|---|
| 156889 | 4/1939 | Germany | 2/227 |

*Primary Examiner*—Gloria M. Hale
*Attorney, Agent, or Firm*—Mark Kusner

[57] ABSTRACT

A garment for covering the lower torso of an individual, comprising a torso portion dimensioned to enclose the mid-section of an individual's body, leg portions extending from the torso portion for enclosing at least the upper portion of an individual's legs, at least one incision in the torso portion having a quick-release attachment system for removal and replacement of the torso portion from the mid-section of the individual, and a fastening arrangement on each of the leg portions for releasably attaching the leg portions to the legs of the individual.

8 Claims, 1 Drawing Sheet

GARMENT FOR HANDICAPPED OR ELDERLY INDIVIDUALS

FIELD OF THE INVENTION

The present invention relates generally to garments, and more particularly to special garments for use by the elderly, handicapped and infirmed.

BACKGROUND OF THE INVENTION

Everyday activities that most people take for granted and perform without notice can present extreme hardships for many elderly, handicapped and infirmed. Those who are physically handicapped through stiffness of joints or through the absence of use are all or part of certain limbs find it extremely difficult to perform many simple daily tasks. In many respects, attending to the elderly, handicapped or bedridden individual also places a considerable burden on a caregiver, i.e., either a nurse, attendant or family member, who typically must assist the handicapped and elderly. For example, many handicapped or elderly individuals who have lost the use of their legs or who simply lack the strength to stand, going to the bathroom requires the assistance of the caregiver to help remove clothing. Such activity generally requires the caregiver to physically support the handicapped individual in an upright position while removing garments. Typically, bedridden, handicapped individuals who have lost the function of their legs or simply cannot stand are clothed in large, bulky garments (such as oversized sweatpants or slacks) which makes removal of such garments easier for the caregiver. While the oversized clothing is generally easier to slide off a patient's legs, such large, bulky clothing creates a considerable problem for caregivers when trying to replace such garments on the elderly or handicapped. In this respect, once the slacks or garments are removed from the patient's torso, they typically fall to the patient's ankles. To reposition the garment on the patient's torso generally requires that the caregiver or family member physically support the patient, either by propping the patient against a wall in an upright position or by supporting the patient's body with one's own body, and then raising the garment back up over the patient's legs and torso. As will be appreciated, supporting the weight of a patient, while at the same time, attempting to reach down to the floor to grab the garment and draw it up over a patient's legs and torso can be an exhausting endeavor for even the youngest and strongest of caregivers.

In another respect, the bulky, oversized loose-fitting garments typically worn by handicapped and elderly patients tends to set such individual apart from other individuals by drawing attention to the patient's condition. The inability to dress and be seen in fashionable and fitting clothes also affects the patient's mental condition and his or her feelings of self worth. In this respect, the bulky, loose-fitting clothes may also be a source of embarrassment to an individual who is already burdened by a physical handicap.

It is, therefore, desirable to provide a garment which is easily removed and replaced from the torso portion of a patient with less effort and strain on the caregiver, and which is also attractive and similar to conventional clothing.

The present invention provides a garment that may be worn by the elderly or handicapped, which garment is not bulky and oversized, yet may be easily removed from the torso portion of a patient and repositioned thereon without excessive effort by an assistant or caregiver.

SUMMARY OF THE INVENTION

In accordance with the present invention, there is provided a garment for covering the lower torso of an individual. The garment is comprised of a torso portion dimensioned to enclose the mid-section of an individual's body. A flap is provided in the torso portion for opening the torso portion to allow easy donning and removal of the torso portion from the mid-section of the individual. A right leg and a left leg portion extend from the torso portion. The right and left leg portions are dimensioned to enclose at least the upper portion of the individual's legs. A fastening arrangement is provided on each of the leg portions for releasably attaching the leg portion of the garment to the legs of the individual. The fastening arrangement is located above the knee to remain in position when the flap or torso portion is opened, and the torso portion is removed from the individual's body.

It is an object of the present invention to provide a garment to be worn by the elderly, handicapped and infirmed.

Another object of the present invention is to provide a garment as described above that can be removed and replaced on a patient with a minimum effort by a caregiver.

Another object of the present invention is to provide a garment as described above which is not bulky or loose fitting, and has the appearance of conventional clothing.

A still further object of the present invention is to provide a garment for use by the elderly, handicapped or infirmed which does not draw attention to the disability of the individual.

Another object of the present invention is to provide a garment as described above which is attractive, neat-looking and comfortable.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
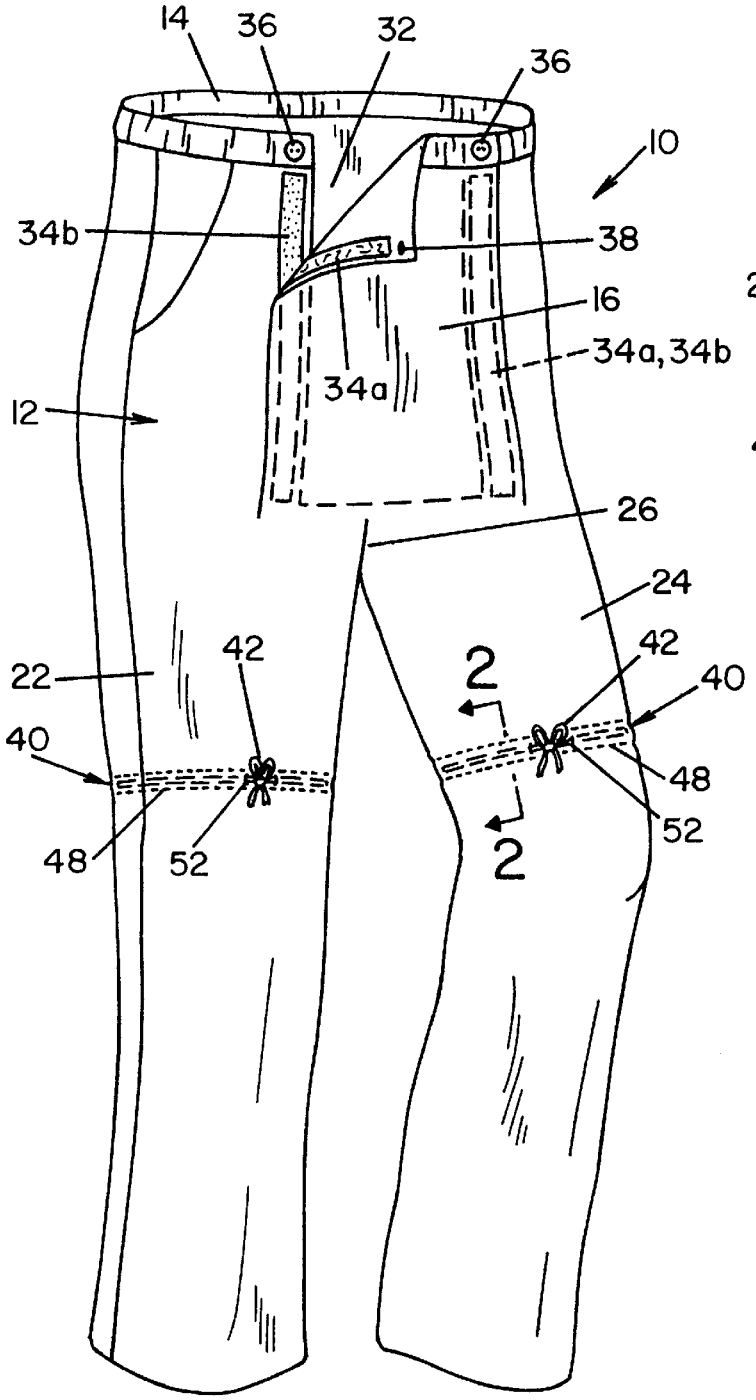
FIG. 1 is a perspective view of a garment illustrating a preferred embodiment of the present invention.

Referring now to the drawings wherein the showings are for the purpose of illustrating preferred embodiments of the invention only, and not for the purpose of limiting same, FIG. 1 shows a garment 10 illustrating a preferred embodiment of the present invention. Broadly stated, garment 10 is comprised of a torso portion 12 having a waistband 14 along the upper edge thereof. A flap 16 is formed in the front of torso portion 12. A right leg portion 22 and a left leg portion 24 extend from a crotch 26. Torso portion 12 is designed to fit around the waist and mid-section of a patient, and leg portions 22,24 are dimensioned to surround a patient's legs, as in a conventional pair of slacks.

In the embodiment shown, flap 16 is generally rectangular in shape and extends from waistband 14 to a point just above crotch 26. Flap 16 defines an opening 32 on the front of garment 10. Opening 32 is typically about 5–8 inches in length, and may be about 6–8 inches in width. Flap 16 is provided to allow easy removal of torso portion 12 from the patient's mid-section. Flap 16 includes attachment means for securing flap 16 to the front of garment 10. In the embodiment shown, VELCRO (which is a registered trademark of Velcro Industries, B.V.) strips 34*a* are fastened along the sides of flap 16. These strips 34*a* are provided to releasably attach to corresponding strips 34*b* fastened along the edges of torso portion 12 defining opening 32. Additional fastening means are provided at waistband 14. In the embodiment shown, buttons 36 are attached to waistband 14 and buttonholes 38 are provided on the upper edge of flap 16 to secure flap 16 to waistband 14. Waistband 14 preferably includes an elastic material (not shown) causing waistband 14 to contract around the waist of the patient.

Figure 2:
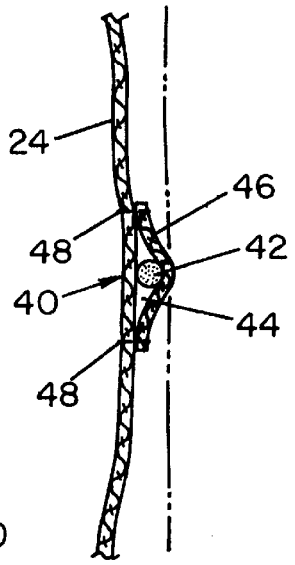
FIG. 2 is a cross-sectional view taken along lines 2—2 of FIG. 1.

A fastening arrangement 40 is provided on each leg portion 22, 24. In the embodiment shown, arrangement 40 is comprised of a drawstring 42 confined within a channel or passage 44, as best seen in FIG. 2. Channel 44 is generally defined by a strip of fabric 46 fastened along the inner surface of leg portions 22, 24. In the embodiment shown, fabric strip 46 is sewn by stitching 48 along the inner surface of leg portions 22, 24 to define channel 44 inside leg portions 22, 24. Apertures 52 are provided in leg portions 22, 24 to allow drawstring 42 to extend to the outer surface thereof. Fastening arrangement 40 is adapted to gather leg portions 22, 24 around the legs of a patient to generally secure same thereto. Fastening arrangement 40 is preferably located on leg portions 22, 24 to be disposed above a patient's knee.

Referring now to the operation of garment 10, when temporary removal of torso portion 12 from a patient's body is required, for example when a patient goes to the bathroom, a caregiver would typically transport the patient to the bathroom by means of a wheelchair. While the patient is still seated in a wheelchair, the caregiver can secure the leg portions 22, 24 to the patient's legs by means of drawstrings 42. In this respect, drawstrings 42 may be used to gather leg portions 22, 24 about the patient's legs. Then drawstrings 42 are tied snugly (but not tightly) to secure leg portions 22, 24 to the patient's legs. The patient may then be moved to an upright position and flap 16 released from torso portion 12 by unbuttoning buttons and pulling flap 16 away from torso portion 12. With flap 16 open, torso portion 12 will fall away from the mid-section of the patient. Fastening arrangement 40 (i.e., drawstrings 42) secures leg portions 22, 24 to the legs of the patient to prevent garment 10 from falling down to the patient's ankles and to the floor. In this respect, torso portion 12 of garment 10 is maintained just below the mid-section of the patient.

When garment 10 is to be reapplied, the caregiver can support the patient upright and easily reach torso portion 12 of garment 10 which is easily accessible about the patient's knees. In this respect, the caregiver need not bend over to reach to the floor, as would be required in the absence of fastening arrangement 40. Thus, a patient may be clothed with garment 10 more easily and quickly with less exertion and effort by the caregiver.

The present invention thus provides a garment for use by the elderly, handicapped and infirmed that enables a caregiver, both in a hospital setting and in a home setting, greater ease in handling and caring for the infirmed. A caregiver is no longer required to prop up a handicapped or elderly person while, at the same time, reach to the floor to try to recover and guide slacks or sweatpants onto a patient's legs and torso. When considering that most home caregivers supporting elderly parents are themselves of generally advanced years, the present invention provides an improvement over garments known heretofore.

At the same time, by providing a garment which may be more closely form-fitted to a patient's body and therefore be closer in appearance to conventional garments, the present invention also provides clothing that makes a handicapped or elderly individual less noticeable and obvious, thereby increasing the mental well-being of the patient.

Figure 3:
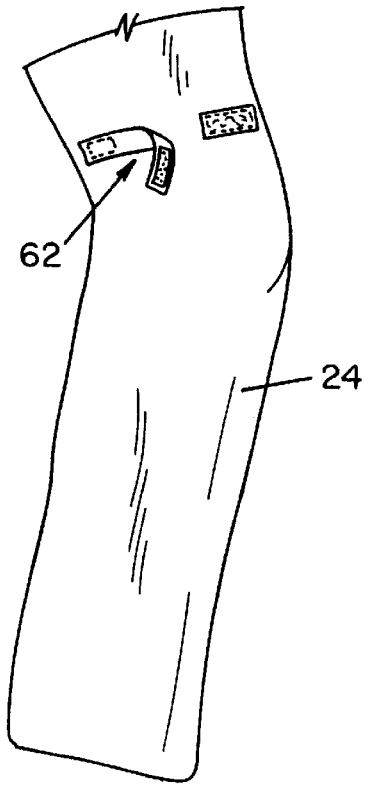
FIG. 3 is a perspective view of a leg portion illustrating an alternate embodiment of the present invention.

Referring now to FIG. 3, an alternate embodiment of the present invention is shown. In FIGS. 1 and 2, a drawstring 42 arrangement is used to secure the leg portions of the garments to the patient's legs. In FIG. 3, a hook and loop fastener strap 62 is shown wherein leg portion of garment 10 may be gathered around a patient's legs using a Velcro® strap arrangement. The invention has been described with respect to preferred embodiments. Modifications and alterations will occur to those skilled in the art upon the reading and understanding of the specification. For example, other means of attachments may be provided for securing leg portions 22, 24 of garment 10 to a patient's legs. For example, snaps or buttons may also be used without deviating from the present invention.

Further, the present invention is not limited by the location of the drawstrings 42 shown in FIG. 1. In this respect, apertures 52 may be positioned to locate drawstrings 42 along the seams of leg portions 22, 24 to make exposed drawstrings 42 less noticeable. In addition, while flap 16 has been shown as being rectangular in shape, a triangular flap, opening to one side may be used without deviating from the present invention. Still further, other features, such as a zipper on flap 16, may be provided to give garment 10 the appearance of conventional slacks or pants. It is intended that all such modifications and alterations be included insofar as they come within the scope of the invention as claimed or the equivalents thereof.

Having described the invention, the following is claimed:

1. A garment for covering the lower torso of an individual, comprising:

a torso portion dimensioned to enclose the mid-section of an individual's body;

leg portions extending from said torso portion for enclosing at least the upper portion of an individual's legs;

at least one incision in said torso portion having a quick-release attachment system for removal and replacement of said torso portion from the mid-section of said individual;

a strip of fabric fastened along the inner surface of each of said leg portion, said strip of fabric defining a channel between said fabric and said leg portion, said channel disposed above the knee region of said leg portion and encircling said leg portion;

an aperture in said leg portion communicating with said channel; and a drawstring extending through said channel, the ends of said drawstring extending through said aperture, said drawstring operable to releasably secure said leg portion of said garment onto the leg of the wearer.

2. A garment as defined in claim 1, further comprising a second incision in said torso portion, said first and second incisions defining a rectangular flap in said torso portion of said garment.

3. A garment as defined in claim 2, wherein said quick-release attachment is comprised of strips of hook and loop fabric attached to said rectangular flap and said torso portion.

4. A garment as defined in claim 3, wherein said upper edge of said torso portion includes an elastic band.

5. A garment as defined in claim 4, wherein an upper edge of said rectangular flap is attached to said torso portion by buttons.

6. A garment as defined in claim 4, wherein an upper edge of said rectangular flap is attached to said torso portion by snaps.

7. A garment for covering the lower torso of an individual, comprising:

a torso portion dimensioned to enclose the mid-section of an individual's body, said torso portion having an upper waistband including an elastic material for contracting about the waist of a wearer of the garment;

leg portions extending from the said torso portion for enclosing at least the upper portion of an individual's legs;

a pair of incisions in said torso portion, said incisions forming a generally rectangular flap in said torso portion, said flap having strips of hook and loop fabric on the lateral edges thereof for attachment to like strip of hook and loop fabric on said torso portion for removal and replacement of flap from and onto said torso portion; and a fastening arrangement on each of said leg portions for releasably attaching said leg portions to the legs of said individual, wherein said fastening arrangement is comprised of drawstrings extending around said leg portions about a knee portion of said leg portions.

8. A garment for covering the lower torso of an individual, comprising:

a torso portion dimensioned to enclose the mid-section of an individual's body;

at least one incision in said torso portion defining a flap having a quick-release attachment means for removal and replacement of said flap from and to said torso portion of said garment;

leg portions extending from said torso portion for covering an individual's legs, said leg portion having an upper leg portion and a lower leg portion;

a releasable fastening arrangement on each of said leg portions for releasably attaching said leg portions to the legs of said individual, said fastening arrangement disposed on said upper leg portion to secure said upper leg portion of said garment onto the leg of the wearer above the knee.

* * * * *